United States Patent [19]

Joshi

[11] Patent Number: 5,041,243

[45] Date of Patent: Aug. 20, 1991

[54] LAUNDRY BAR

[75] Inventor: David Joshi, South Plainfield, N.J.

[73] Assignee: Colgate-Palmolive Company, Piscataway, N.J.

[21] Appl. No.: 428,987

[22] Filed: Oct. 30, 1989

[51] Int. Cl.[5] ..... C11D 3/065; C11D 1/14; C11D 1/755

[52] U.S. Cl. ..... 252/534; 252/174.25; 252/531; 252/533; 252/550; 252/553

[58] Field of Search ..... 252/174.25, 533, 550, 252/DIG. 16, 531, 534, 553

[56] References Cited

U.S. PATENT DOCUMENTS

| | | | |
|---|---|---|---|
| 3,223,647 | 12/1965 | Drew et al. . | |
| 4,198,311 | 4/1980 | France et al. . | |
| 4,263,177 | 4/1981 | Egän et al. . | |
| 4,543,204 | 9/1985 | Gervasio | 252/531 |
| 4,705,644 | 11/1987 | Barone et al. . | |
| 4,787,110 | 11/1988 | Barone et al. . | |
| 4,828,752 | 5/1989 | Nagarajan . | |

FOREIGN PATENT DOCUMENTS 2189255 10/1987 United Kingdom .

OTHER PUBLICATIONS

Sax and Lewis, *Hawley's Condensed Chemical Dictionary,* Van Nostrand Reinhold Company, New York, 11th Edition, p. 53.

*Primary Examiner*—Paul Lieberman
*Assistant Examiner*—Alexander G. Ghyka
*Attorney, Agent, or Firm*—Robert Sullivan; Murray Grill; Richard Ancel

[57] ABSTRACT

A detergent laundry bar based on an alkyl benzene sulfonate, higher fatty alcohol sulfate detergent which has improved foamability and skin mildness is disclosed. The formulation consists of 10 to 35% alkyl benzene sulfonate 10 to 35% higher fatty alcohol sulfate 10 to 30% of a builder for the detergent mixture, a body portion in range of 10 to 30%, about 1 to 10% cocoamido propylamine oxide and about 5 to 20% water.

2 Claims, No Drawings

LAUNDRY BAR

Field of the Invention

This invention relates to detergent bars, more particularly, to a detergent laundry bar in which one of the principle active detersive components is a higher fatty alcohol sulfate.

When laundry detergent bars are made with coco fatty alcohol sulfate either as a main surfactant or as part of the overall active system, the resultant product suffer from properties such as poor foamability and skin harshness. In addition when the coco fatty alcohol sulfate is used subject to 70–80% AIP form, it requires heating to 60° to 65° C. to enable additions to the formative batch. In this case extra heat in the batch makes the bar processing very difficult at higher temperatures.

In an alternate procedure the coco fatty alcohol sulfate is pre-dried in the form of flake or powder for homogeneous batch mixing and adequate processing in the bar making line.

It has now been found that a problems of poor foaming, mildness and difficult processing can be avoided by incorporating small amounts of cocoamido propylamine oxide surfactant to the formulation.

BACKGROUND OF THE INVENTION

Soap bars have long been employed for washing the human body and for "doing laundry". Before the advent of washing machines dictated the employment of detersive materials in powder, disintegrable briquette or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabrics being laundered, as on a washboard, to deposit a high concentration of the soap on the soiled area, and they provided mechanical means for applying energy to such surfaces to assist in removing the stains and soils.

Despite the fact that after the introduction of synthetic organic detergents and washing machines the amount of soap employed for laundry use diminished greatly, soap in bar or cake form is still the personal cleaning agent of choice in most of the world, the laundry soaps and detergents in bar form are also still preferred by many consumers in various regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require the purchase of a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

A search of the prior art has resulted in the finding of the various patents and publications which, while they refer to detergent laundry bars and bar products containing higher fatty alcohol sulfate do not make the present invention obvious to one skilled in the art.

A method of aleviating the tendency of laundry bars to crack is disclosed in U.S. Pat. No. 4,543,204. U.S. Pat. No. 4,705,644 discloses detergent laundry bars with improved mildness that contain sodium alpha sulfo higher fatty acid methyl ester as one of the components U.S. Pat. No. 4,263,177 discloses amine oxide foam stabilizers for alkyl benzene sulfonate foaming agents. U.S. Pat. No. 3,223,647 discloses mild detergent compositions that contain alkyl benzene sulfonates and tertiary amine oxides. U.S. Pat. No. 4,828,752 discloses a toilet bar containing a synthetic polymeric thickner to impart improved processablity to the soap. U.S. Pat. No. 4,198,311 discloses a skin conditioning toilet bar that contains an alkali metal salt of an acyl lactylate or glycalate.

U.S. Pat. No. 4,543,204 discloses a detergent laundry bar that contains higher alchohol fatty sulfate and a higher fatty acid alkanol amide to avoid the breakage problems often associated with laundry bars containing higher alcohol sulfate.

None of the references alone or in combination discloses or makes obvious in combination sodium coco alkyl sulfate, sodium higher fatty acid sulfonates, cocoamido propylamine oxide, sodium tripolyphosphate, sodium carbonate, sodium silicate, calcium carbonate, talc and water in the detergent bar.

DETAILED DESCRIPTION OF THE INVENTION

The higher fatty alcohol fatty sulfate is one of which the higher fatty alcohol is normally in the range of 10 to 18 carbon atoms, The cations will almost invariably be sodium although other cations such as potassium, ammonium, magnisium and calcium may be present, usually in minor amounts with the sodium detergent normally constituting more than 50% preferrably more than 75% and most preferably substantially all of the fatty alcohol sulfate content of the laundry bar.

The fatty alcohol sulfate is preferrably derived from coconut oil although palm and/or palm kernel oils may also be used.

The combination also preferably contains approximately an equal amount of an alkyl benzene sulfonate. The alkyl moiety of the sulfonate can be in the range of 10 to 18 carbon atoms. The cation will almost invariably be sodium although potassium ammonium, magnesium and calcium may also be present normally in minor amounts.

Various water soluble builder salts usually sodium salts may be incorporated in the laundry bars. One of the most important is the phosphates particularly the polyphosphates such as sodium tripolyphosphate and sodium pyrophosphate. Other builder salts are of the chelating or prcipitating types may also be used. The inorganic salts are preferred. The preferred salts are sodium carbonate and sodium silicate. The ratio of $Na_2O$ to $SiO_2$ in the sodium silicate can be approximately 1.1 to 1.6 to 1 to 3 preferably 1 to 2 to 1 to 3. In addition to the water soluble builders some water insoluble builders may be used such as detergent building calcium ion-exchanged zeolite including the hydrated zeolites. Zeolite A is preferred.

Water insoluble particulate material components of the present bar hereafter referred to an bodying agents contribute significantly to the formation of a firm, yet processable laundry bar, and help to regulate the release of detergent from the bar when in use. While many insoluble materials may be employed such as clays, talc, calcium silicate, magnesium silicate, calcium sulfate, silica calcium phosphate, and calcium carbonate, the most important of these materials is calcium carbonate, often obtained from calcite.

The calcium carbonate and other insolubles will normally be in finely divided form and often all or substantially all pass through a number 200 seive.

Various adjuvants may be employed in the present detergent laundry bars for their individual desirable effects. Among these adjuvants are dyes, such as red or blue dyes and ultramarine blue pigment, whitening agents such as titanium oxide, perfumes and brighteners can be present.

The essential feature of the invention is pointed out above is the addition of 1 to 10% preferrably 3 to 5% cocoamido propylamine oxide. The addition of this component to the formulation had been found to improve the foamability, processability and skin mildness of the laundry bar.

In addition to the above components water will be present in the laundry bar. While it is preferred to employ deionized water, tap water or city water may be used. The water serves as a mutual solvent and plasticising agent for various components of the detergent bar and facilates hydration of some of the hydratable materials such as sodium polyphosphate, sodium pyrophosphate, sodium carbonate, sodium sulfate, etc.

The final bar will have a total content of coco alcohol sulfate and sodium alkyl benzene sulfonate of about 10 to 40%, preferrably 20 to 35%. The formulations preferrably contain approximately equal amounts of sodium alkyl benzene sulfonate and sodium coco fatty acid sulfate. In the especially preferred formulation each component is present as about 19 to 20% of the formulation.

The builder content will normally be in the range of 10 to 30 % preferrably 15 to.20%.

The water content of the formulation is normally about 5 to 22% preferably 5 to 15% and more preferably 6 to 12%. With respect to individual builders and bodying agents it is prefered that the builders include 5 to 25% sodium tripolyphosphate 5 to 25% sodium carbonate 0 to 10% sodium silicate preferably 1 to 2%. The bodying agent preferably a water insoluble powder will consist of 10 to 40% preferably 15 to 30% calcium carbonate.

The adjuvant content of the formulation will usually be limited to 5% preferably 2%. The individual adjuvants will normally be present as 0.1 to 1% of the formulation.

The invented detergent laundry bars can be processed with available equipment of types used for manufacturing soap and detergent bar products. Initially, a heavy duty amalgamator or mixer, such as one equipped with sigmal-type blades or one equipped with counter-rotating paddle type agitators, is used to mix the various components, most of which are powdered but some of which may be in liquid state, sometimes as aqueous solutions.

The order of addition of the various components of the laundry bars is not considered to be important as long as reasonable care is taken to prevent complete or premature hydration of the phosphate (and any other hydratable components which desirably hydrate during working of the composition), and to prevent any excessive lumping or concretion which could occur in the mixing process. The mixing may take only a short time, but can take from one minute to an hour, with the usual mixing time being from 5 to 15 minutes.

The mixed product will desirably be in separable solid form at about room temperature and will be charged, preferably by means of a multi-worm transfer conveyor (preferably equipped with cooling means), to a multirolled mill, such as a five-roll Lehmann mill of the soap mill type. The mill will be equipped with means for heating and cooling and normally the cooling means will be employed to maintain the ribbon temperature from the mill within the range of about 30° to 40° to 45° C. Various ribbon and chip thicknesses may be employed but usually such thicknesses will be in the range of 0.1 to 1 mm., preferably 0.2 to 0.4 or 0.5 mm. However, other thicknesses may be made, depending on particular formulations being milled, so long as the composition is satifactorily homogenized on the mill and providing that any coarse particles that may be present are pulverized so that the finished product is not objectionably gritty.

The milled chips, or milled materials, in other form, are then conveyed to a double or triple stage vacuum plodder, operating at a high vacuum e.g., 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. The bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping.

The previous description is one for the manufacture of the laundry detergent bars of this invention when the anionic detergents are added to the mixer in powder, flake or paste form. However, one or more of such detergents, may also be formed in situ by neutralizing the appropriate corresponding detergent acid(s) with soda ash or other suitable neutralizing agent, when that is feasible. Such a reaction may result in the production of sodium sulfate from any excess sulfuric acid present or if excess soda ash is employed sodium carbonate may result. Unreacted higher fatty alcohol may also be present with the detergent. All such materials are useful components of the present laundry bars. The described neutralization reaction may be effected in a separate reactor but may also be conducted in the mixer to be employed for mixing the other laundry bar constituents with the anionic detergents.

The detergent laundry bars made according to this invention have superior foamability, processability and mildness characteristic due to the presence of about 1 to 10% preferably 2 to 5% cocoamido propylamine oxide in the formulation. The result is that an improved synthetic organic detergent laundry bar has now been made which includes coco fatty alcohol sulfate but also has better foaming, processing and mildness properties than the previous higher fatty alcohol sulfate bar. The invention is illustrated by the following specific but non limiting examples.

EXAMPLE 1

A detergent bar having the components set out in table I below was made by a process which includes a step of mixing, milling plodding, cutting to lengths and pressing to shape as set out above.

TABLE I

| Bar Formulation in percent | |
|---|---|
| Sod. Alkyl Benene Sulfonate | 19.2 |
| PVM/MaCopolymer (Gantrez AN-119) 10% Solution | 0.5 |
| Magnesium Sulfate Peptahydrate | 0.8 |
| Sodium Silicate Solution (44%) | 1.25 |
| Trisodium Pyrophosphate | 2.50 |
| Sodium Aluminum Silicate (Zeolite A) | 2.50 |
| Sodium Carbonate | 7.50 |
| Coco Fatty Alcohol Sulfate Paste (70% AI) | 19.00 |
| Sodium Carbonate | 7.50 |
| Calcium Carbonate | 17.50 |
| Minors (Colors, Perfume, Brighterners, etc.) | 1.00 |
| Calcium Carbonate | Q.S. |
| Trisodium Pyrophosphate | 12.5 |

No cocoamino propylamine oxide was added to this formulation.

EXAMPLE 2

A detergent bar of the formulation given below was prepared using the same techniques as set out in Example 1 except that 5% of liquid cocoamido propylamine oxide was premixed with the coco fatty alchohol sulfate paste. The resultant mixture was fluid at 25° to 40° C. This mixture made the batch mixing easier without the need to cool the batch and thus avoided the possibility of lump formation.

TABLE II

| Bar Formulation in percent | |
|---|---|
| Sod. Alkyl Benzene Sulfonate | 19.2 |
| PVM/MaCopolymer (Gantrez AN-119) 10% Solution | 0.5 |
| Magnesium Sulfate Peptahydrate | 0.8 |
| Sodium Silicate Solution (44%) | 1.25 |
| Trisodium Pyrophosphate | 2.5 |
| Sodium Aluminum Silicate (Zeolite A) | 2.5 |
| Sodium Carbonate | 7.5 |
| Coco Fatty Alcohol Sulfate Paste (70% AI) | 14.00 |
| Cocoamido Propylamine Oxide (30% AI) | 5.0 |
| Sodium Carbonate | 7.50 |
| Calcium Carbonate | 17.5 |
| Minors (Colors, Perfume, Brightners, etc.) | 1.0 |
| Calcium Carbonate | Q.S. |
| Trisodium Pyrophosphate | 12.5 |

The bars were evaluated by expert evaluators and by consumers and found to have satisfactory utilizarian and aesthetic characteristics. The bars are found to foam, persist in foam and refoam satisfactory, feel good to the hands of the user, clean well, to be sufficiently hard and not to be consumed too quickly.

EXAMPLE 3

A foaming test run was completed to evaluate the inventive bars and controls and accurately reflect actual use conditions of the detergent laundry bars. In actual use the items to be washed are wet and then rubbed on a washboard with the laundry bar. After rubbing enough detergent composition into the item to be cleaned the item is rubbed on the washboard or other hard surface until any dirt is removed, is then rinsed and then retreated.

In a test devised to yield data corresponding to that from the hand washing process, the equipment used was a stroke lather machine, consisting of a wooden block with a sponge attached and a 400ml plastic beaker. In the run the bar to be tested was weighed and clamped lengthwise into the machines clamp. The block and the sponge clean and wet was attached to the machine metal plate. Two beakers containing 4 liters of deionized water were positioned under the sponge. The machine was started and stopped after 25 and 50 strokes and the foam height in millimeters was measured. After a five minute interval the foam height was measured again. The bar was dried, weighed and reclamped to make sure the same side was touching the bar. The machine was started again and stopped after 100 strokes and the foam height was measured and recorded. The machine was started again and stopped after the 200th stroke and the foam height recorded. Again the bar was dried and the final weight recorded. The data collected in the runs to compare the foaming properties of the formulation set out in table 1 and 2 above is set in table III below.

TABLE III

| | Bar Abrasion Foam Tests (Stroke Machine) Foam mm/% Bar Used | | | | | |
|---|---|---|---|---|---|---|
| | 25 Strokes | 50 Strokes | 5 Min. Rest | 100 Strokes | 200 Strokes | Average |
| Formulation of Table I 30/13.8 30/13.8 No Amine Oxide | 16/3.9 | 28/7.9 | 22 | 35/15.3 | 50/28.0 | = 2.2 |
| Formulation of Table II 5% Amine Oxide | 24/3.4 | 35/6.2 | 30 | 40/12.6 | 75/24.6 | 41/11.7 = 3.5 |

It is obvious from data that a substantial improvement in foamability results from the addition of 5% cocoamido propylamine oxide to the formulation.

Obviously many modifications and variations of the invention may be made without departing from the essence and scope thereof. Only such limitations should be applied as are listed in the appended claims.

What is claimed is:

1. A detergent bar having improved foamability and mildness consisting essentially of:
   (a) 10–40 percent alkyl benzene sulfonate,
   (b) 10 to 40 percent higher fatty alcohol sulfate having 10–18 carbon atoms,
   (c) 5–30 percent sodium tripolyphosphate,
   (d) 5–25 percent sodium carbonate,
   (e) 10–40 percent calcium carbonate,
   (f) 1–2 percent sodium silicate,
   (g) about 2.5 percent zeolite,
   (h) about 0.8 percent magnesium sulfate,
   (i) about 1 to 10 percent cocoamido propylene oxide,
   (j) about 5–20 percent water.

2. A milled plodded detergent bar according to claim 1 consisting essentially of:
   (a) 10–25 percent sodium alkyl benzene sulfonate,
   (b) 10–25 percent sodium coco fatty alcohol sulfate,
   (c) 3 to 5 percent cocoamido propylene oxide,
   (d) 15 to 30 percent sodium tripolyphosphate,
   (e) 5 to 15 percent water,
   (f) 5 to 25 percent sodium carbonate,
   (g) 1 to 2 percent sodium silicate,
   (h) about 0.8 percent magnesium sulfate,
   (i) about 2.5 percent zeolite,
   (j) 15 to 30 percent calcium carbonate.

* * * * *